US010351391B2

(12) United States Patent
Cao et al.

(10) Patent No.: US 10,351,391 B2
(45) Date of Patent: Jul. 16, 2019

(54) VARIABLE GRADIENT INCLINED RUNNING CONTAINER TRACTION ROPE ADJUSTMENT APPARATUS AND METHOD

(71) Applicant: CHINA UNIVERSITY OF MINING AND TECHNOLOGY, Jiangsu (CN)

(72) Inventors: Guohua Cao, Jiangsu (CN); Lei Wei, Jiangsu (CN); Zhencai Zhu, Jiangsu (CN); Weihong Peng, Jiangsu (CN); Xiaoguang Bo, Jiangsu (CN); Lei Wang, Jiangsu (CN); Wei Li, Jiangsu (CN); Gongbo Zhou, Jiangsu (CN)

(73) Assignee: CHINA UNIVERSITY OF MINING AND TECHNOLOGY (CN)

( * ) Notice: Subject to any disclaimer, the term of this patent is extended or adjusted under 35 U.S.C. 154(b) by 0 days.

(21) Appl. No.: 15/559,004

(22) PCT Filed: Dec. 22, 2015

(86) PCT No.: PCT/CN2015/098177
§ 371 (c)(1),
(2) Date: Sep. 15, 2017

(87) PCT Pub. No.: WO2017/071028
PCT Pub. Date: May 4, 2017

(65) Prior Publication Data

US 2018/0222719 A1 Aug. 9, 2018

(30) Foreign Application Priority Data

Oct. 27, 2015 (CN) ..... 2015 1 0705607

(51) Int. Cl.
*B66B 9/06* (2006.01)
*B66B 5/12* (2006.01)
(Continued)

(52) U.S. Cl.
CPC ..... *B66B 9/06* (2013.01); *B66B 5/12* (2013.01); *B66B 7/02* (2013.01); *B66B 7/04* (2013.01);
(Continued)

(58) Field of Classification Search
CPC ..... B66B 7/06; B66B 9/06; B66B 9/193
See application file for complete search history.

(56) References Cited

U.S. PATENT DOCUMENTS 2,941,681 A * 6/1960 Reyes ..... B65G 67/06 414/594
3,312,307 A * 4/1967 Camp ..... B61B 9/00 187/245
(Continued)

FOREIGN PATENT DOCUMENTS

CN 103935865 7/2014 ..... B66B 5/00
CN 105151951 12/2015 ..... B66B 7/10
(Continued)

OTHER PUBLICATIONS

International Search Report (w/translation) and Written Opinion (w/o translation) issued in application No. PCT/CN2015/098177, dated Aug. 2, 2016 (9 pgs).

*Primary Examiner* — Michael C McCullough
(74) *Attorney, Agent, or Firm* — Hayes Soloway P.C.

(57) ABSTRACT

A traction rope adjustment apparatus includes a traction rope pressing device, and a traction rope pulley apparatus. The traction rope lifting apparatus prevents the traction rope sagging, the traction rope pressing apparatus prevents the traction rope drifting, and the traction rope pulley apparatus enables a car and the counterweight to smoothly pass through the traction rope pressing apparatus, thereby implementing forced guidance of the traction rope and the reliable and smooth running of the car and counterweight. The apparatus can meet the demands of variable gradients and
(Continued)

can implement reliable running of an inclined running container in variable gradients, such that the traction rope adapts to the different gradients, solving the challenge of the development of an inclined running container that self-adapts to gradients.

7 Claims, 5 Drawing Sheets

(51) Int. Cl.

| | |
|---|---|
| ***B66B 7/02*** | (2006.01) |
| ***B66B 7/04*** | (2006.01) |
| ***B66B 7/08*** | (2006.01) |
| ***B66B 17/12*** | (2006.01) |
| ***B66B 7/06*** | (2006.01) |

(52) U.S. Cl.
CPC ..... *B66B 7/06* (2013.01); *B66B 7/08* (2013.01); *B66B 17/12* (2013.01)

(56) References Cited

U.S. PATENT DOCUMENTS

| | | | | | |
|---|---|---|---|---|---|
| 3,831,714 | A * | 8/1974 | Hedman | B66B 9/00 | 104/127 |
| 4,026,388 | A * | 5/1977 | Creissels | B61B 9/00 | 187/245 |
| 4,534,451 | A * | 8/1985 | Peter | B66B 9/06 | 187/245 |
| 5,125,481 | A * | 6/1992 | Shibata | B66B 9/00 | 187/245 |
| 6,460,657 | B1 * | 10/2002 | Isenburg | B66B 15/04 | 187/245 |
| 9,382,101 | B2 * | 7/2016 | Friedrich | B64D 11/0007 | |
| 2011/0290590 | A1 | 12/2011 | Drew et al. | 187/245 | |

FOREIGN PATENT DOCUMENTS

| | | | | |
|---|---|---|---|---|
| CN | 205114765 | 3/2016 | B66B 7/10 | |
| JP | S57126479 | 8/1982 | B65H 57/14 | |
| JP | 01220691 A * | 9/1989 | B66B 9/06 | |

* cited by examiner

VARIABLE GRADIENT INCLINED RUNNING CONTAINER TRACTION ROPE ADJUSTMENT APPARATUS AND METHOD

TECHNICAL FIELD

The invention relates to a variable gradient inclined running container traction rope adjustment apparatus and method, and is particularly suitable for an inclined running container running on a variable gradient or a variable trajectory as a result of the shape of a building or roadway working conditions.

BACKGROUND TECHNOLOGY

The elevator, as modem transport means, plays an important role in the transportation of high-rise buildings. The inclined running container, as a product of the development of special elevators, can be applied in tourist spots, areas where the houses are built on mountain slopes as the urban land is in short supply, complex roadways and is used by maintenance personnel for the routine maintenance and repair of high towers and major bridges. The variable gradient inclined running container is suitable for the transport on the slope with a certain variable gradient, breaking the layout concept of the conventional inclined running container, thereby having strong creativity and uniqueness. With the improvement of people's living standards, the inclined running container for sightseeing and high and low dwellings is widely applied in inclined mountain slope areas and buildings, and the characteristics of the inclined running container including high transport capacity, high speed and long travel can also make tourists enjoy the good scenery.

At present, the use of the inclined running container has become increasingly widespread, and most of the existing inclined running containers are invariable in gradient, which causes great constraint to the development of the inclined running container. The development of the variable gradient inclined running container will greatly improve the applicable conditions of the inclined running container, however, the steel wire rope of the inclined running container may have the phenomena of sagging and drifting in the running process, hence, a variable gradient inclined running container traction rope adjustment apparatus needs to be designed to solve the above problems, so that the traction steel wire rope can adapt to the change of gradients.

THE CONTENTS OF THE INVENTION

Technical problem: aiming at the problems in the prior art, it is an object of the present invention to provide a variable gradient inclined running container traction rope adjustment apparatus which is simple and compact in structure, is safe and reliable, occupies small space and makes the entire system run smoothly and a method. Technical solution: the variable gradient inclined running container traction rope adjustment apparatus of the present invention comprises upper and lower guide rails, a counterweight apparatus, a traction rope, a traction machine and a supporting seat supporting the car and riding on the upper guide rail, wherein the traction machine is arranged on the top of the variable slope; one end of the traction rope winding around the traction machine is connected with the supporting seat running on the upper guide rail, and the other end is connected with the counterweight apparatus running on the lower guide rail; the bottoms of the traction rope connecting car and the counterweight device are respectively provided with the traction rope pulley apparatus; the traction rope lifting apparatus is arranged on a support frame of the upper and the lower guide rails, positioned at the lower section of the slope, and the traction rope pressing apparatus is arranged on a support frame positioned at the upper section of the slope; a traction rope guide pulley is arranged below the traction machine; and the bottom of the car is provided with a movable connecting plate, one side of the front end of the upstream between the movable connecting plate and the supporting seat is hinged, and automatic leveling assemblies are connected to one side of the rear end of the upstream.

The supporting seat comprises a lifting platform, a support frame arranged on the upper part of the lifting platform and a car guide shoe arranged at the bottom of the lifting platform.

The traction rope robe lifting apparatus comprises a bearing member, angle cleats arranged at both ends of the bearing member, and a connecting shaft connecting the bearing member and the angle cleats.

The traction rope pressing apparatus comprises two connecting plates with the same structure, which are symmetrically fixed on the guide rail frame, wherein three vertical plates with the same structure are arranged on the upper part of the connecting plate equidistantly in parallel; a rotary wheel is arranged on the upper part of each vertical plate; an upper wheel is arranged on the upper part of the rotary wheel; rotary pins and positioning pins are respectively fixedly connected among the three vertical plates in parallel; a rotary block rotating around the rotary pin is arranged on the rotary pin; a connecting pin is arranged at the end of the rotary block; a central shaft passing through the rotary wheel and connected with the upper wheel is welded on the upper part of the rotary block; a bearing matched with the central shaft is arranged in the rotary wheel; one end of the bearing is positioned via a shaft shoulder of the central shaft, and the other end is positioned via a shaft sleeve; one end of the rotary wheel is limited via the bearing, and the other end is limited via a retainer ring; a spring is arranged between the positioning pin and the connecting pin; and one end of the spring is fixed to the positioning pin, and the other end is fixed to the connecting pin.

The counterweight apparatus comprises a front counterweight and a rear counterweight, the front and the rear counterweights are hinged together, and counterweight guide shoes are arranged at the bottom of the front and rear counterweights symmetrically.

The traction rope pulley apparatus comprises a rope threading pulley, side plates distributed on both sides of the pulley, and a bolt connecting the pulley and the side plates.

Regarding the variable gradient inclined running container traction rope adjustment method using the above apparatus, when the inclined running container runs, the bearing member of the traction rope lifting apparatus will lift the traction rope, and the rotary wheel of the traction rope pressing apparatus will compress the traction rope, thereby achieving the forced guidance of the traction rope; when the car or the counterweight apparatus passes through the traction rope pressing apparatus, the side plates of the traction rope pulley apparatus arranged at the bottom of the supporting seat and the counterweight apparatus will push aside the upper wheel towards left and right sides, so that the car and the counterweight apparatus can smoothly pass through the traction rope pressing apparatus; and after the car or the counterweight apparatus passes through the traction rope pressing apparatus, the upper wheel will, under the action of the spring, return, and the traction rope will be pressed between the rotary wheels again.

Beneficial effects: with the above-mentioned technical solution, the traction rope lifting apparatus and the traction rope pressing apparatus are arranged on the guide rail frame to forcibly guide the traction rope, thereby preventing the sagging and drifting of the traction rope with the fluctuation of the slope effectively and ensuring the normal traction lifting; and the traction rope pulley apparatus installed on the supporting seat and the counterweight apparatus effectively ensures that the car and the counterweight apparatus can smoothly pass through the traction pressing apparatus, making the entire traction system run smoothly. Compared with the prior art, the present invention is simple in structure, safe and reliable and easy to maintain, and has obvious effects and a wide range of practicality.

DESCRIPTION OF ACCOMPANYING DRAWINGS

In the Figures: 1—car; 2—movable connecting plate; 3—automatic leveling assembly; 4—supporting seat; 4-1—lifting platform; 4-2—support frame; 4-3—car guide shoe; 5—traction rope lifting apparatus; 5-1—bearing member; 5-2—connecting shaft; 5-3—angle cleat; 6—traction rope pressing apparatus; 6-1—upper wheel; 6-2—rotary wheel; 6-3—vertical plate; 6-4—connecting plate; 6-5—rotary pin; 6-6—rotary block; 6-7—positioning pin; 6-8—spring; 6-9—bearing; 6-10—central shaft; 6-11—shaft sleeve; 6-12—retainer ring; 6-13—connecting pin; 7—counterweight apparatus; 7-1—rear counterweight; 7-2—front counterweight; 7-3—counterweight guide shoe; 8—traction rope pulley apparatus; 8-1—bolt; 8-2—side plate; 8-3—rope threading pulley; 9—traction rope guide pulley; 10—traction rope; 11—traction machine.

Figure 1:
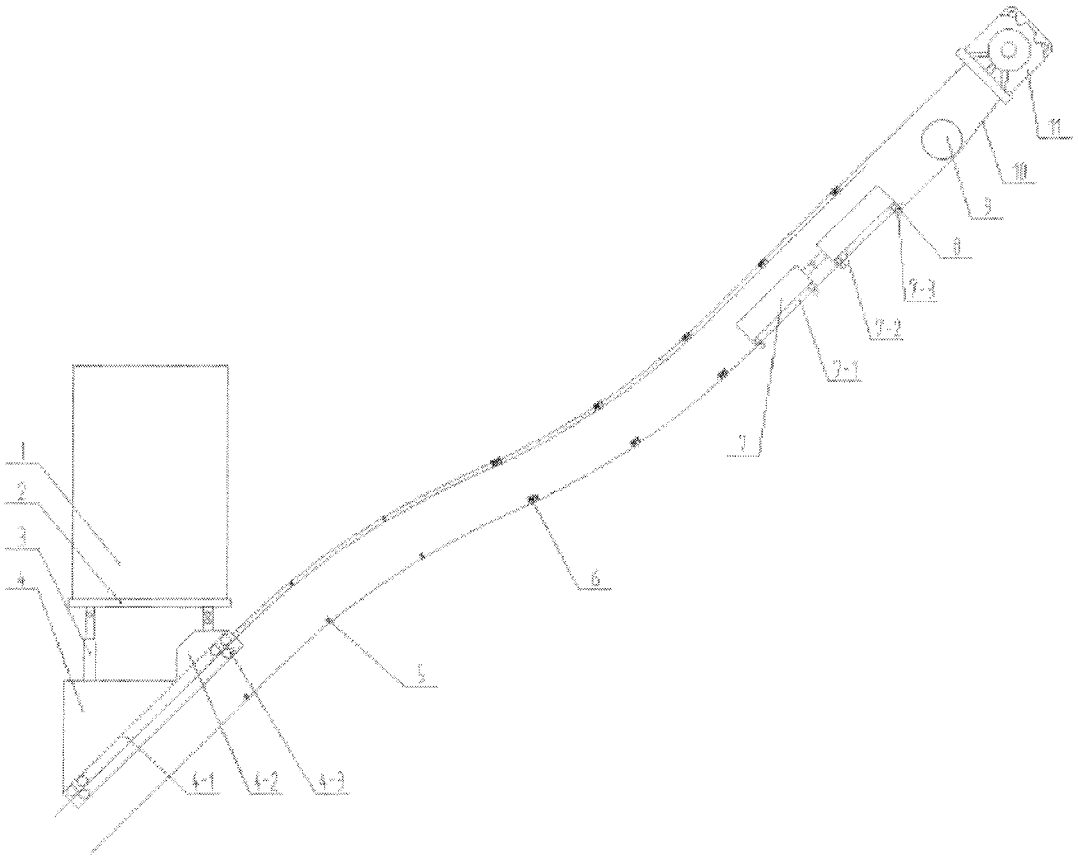
FIG. 1 is a front view of the installation of the integral traction system of the present invention.

Embodiments:

An example of the present invention will now be described further with reference to the accompanying drawings:

As shown in FIG. 1, the variable gradient inclined running container traction rope adjustment apparatus mainly comprises upper and lower guide rails, the counterweight apparatus 7, the traction rope 10, the traction machine 11, and the supporting seat 4 supporting the car 1 and riding on the upper guide rail. The traction machine 11 is arranged on the top of the variable slope; one end of the traction rope 10 winding around the traction machine 11 is connected with the supporting seat 4 running on the upper guide rail, and the other end is connected with the counterweight apparatus 7 running on the lower guide rail; and the supporting seat 4 comprises the lifting platform 4-1, the support frame 4-2 arranged on the upper part of the lifting platform 4-1, and the car guide shoe 4-3 arranged at the bottom of the lifting platform 4-1. The bottoms of the traction rope 10 connecting car 1 and the counterweight apparatus 7 are respectively provided with the traction rope pulley apparatus 8; and the counterweight apparatus 7 comprises the rear counterweight 7-1, the front counterweight 7-2 hinged with the rear counterweight 7-1 and the counterweight guide shoe 7-3 arranged at the bottom of the rear counterweight 7-1 and the front counterweight 7-2. The traction rope lifting apparatus 5 is arranged on the support frame of the upper and the lower guide rails, positioned at the lower section of the slope, and the traction rope pressing apparatus 6 is arranged on the support frame positioned at the upper section of the slope; the traction rope guide pulley 9 is arranged below the traction machine 11; the movable connecting plate 2 is arranged at the bottom of the car 1; the supporting seat 4 is arranged below the movable connecting plate 2; and one side of the front end of the upstream between the movable connecting plate 2 and the supporting seat 4 is hinged, and automatic leveling assembly 3 is connected to one side of the rear end of the upstream.

Figure 2:
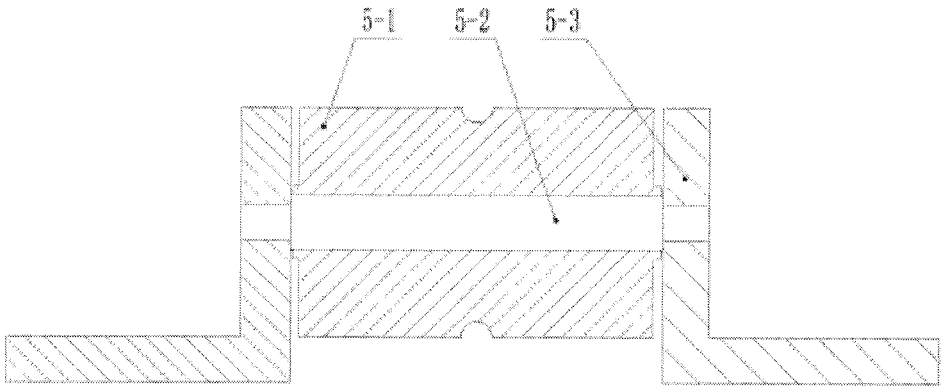
FIG. 2 is a front view of the traction rope lifting apparatus of the present invention.

As shown in the FIG. 2, the traction rope lifting apparatus 5 comprises the bearing member 5-1, angle cleats 5-3 respectively fixedly connected with two ends of the bearing member 5-1 and the connecting shaft 5-2 connecting the bearing member 5-1 and the angle cleats 5-3.

Figure 3:
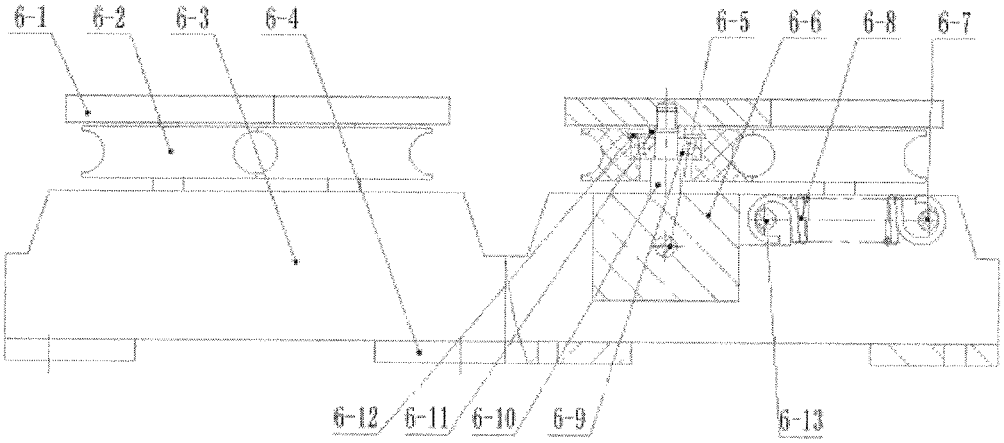
FIG. 3 is a front view of two traction rope pressing apparatuses with parallel arrangement of the present invention.
Figure 4:
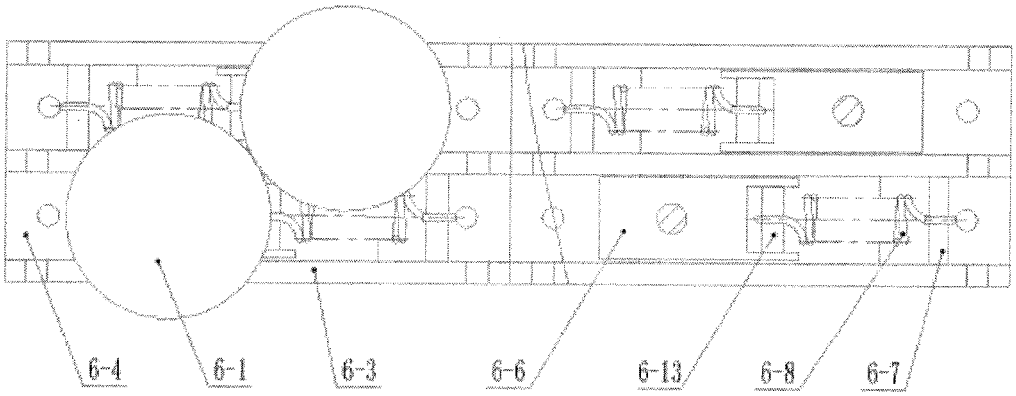
FIG. 4 is a plan view of two traction rope pressing apparatuses with parallel arrangement of the present invention.

As shown in the FIGS. 3 and 4, the traction rope pressing apparatus 6 comprises two connecting plates 6-4 with the same structure, which are symmetrically fixed on the guide rail frame, wherein three vertical plates 6-3 with the same structure are arranged on the upper part of the connecting plate 6-4 equidistantly in parallel; a rotary wheel 6-2 is arranged on the upper part of each vertical plate 6-3; an upper wheel 6-1 is arranged on the upper part of the rotary wheel 6-2; rotary pins 6-5 and positioning pins 6-7 are respectively fixedly connected among the three vertical plates in parallel; a rotary block 6-6 rotating around the rotary pin 6-5 is arranged on the rotary pin 6-5; a connecting pin 6-13 is arranged at the end of the rotary block 6-6; a central shaft 6-10 passing through the rotary wheel 6-2 and connected with the upper wheel 6-1 is welded on the upper part of the rotary block 6-6; a bearing 6-9 matched with the central shaft 6-10 is arranged in the rotary wheel 6-2; one end of the bearing 6-9 is positioned via a shaft shoulder of the central shaft 6-10, and the other end is positioned via a shaft sleeve 6-11; one end of the rotary wheel 6-2 is limited via the bearing 6-9, and the other end is limited via a retainer ring 6-12; a spring (6-8) is arranged between the positioning pin 6-7 and the connecting pin (6-13); and one end of the spring 6-8 is fixed to the positioning pin 6-7, and the other end of the spring 6-8 is fixed to the connecting pin 6-13.

Figure 5:
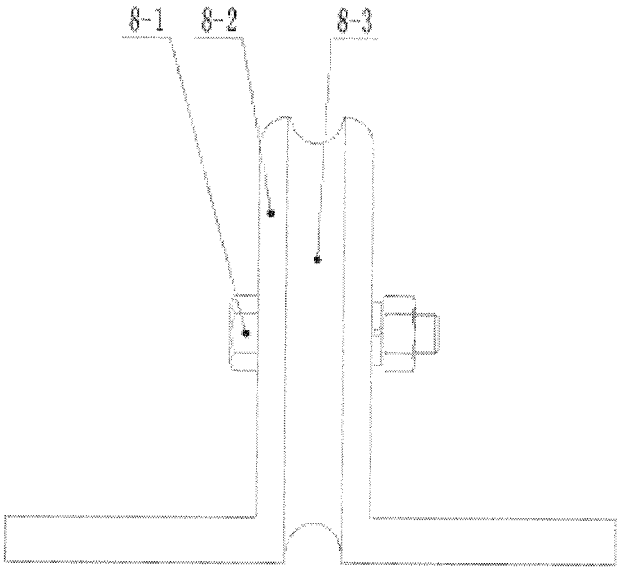
FIG. 5 is a front view of the traction rope pulley apparatus of the present invention.

As shown in the FIG. 5, the traction rope pulley apparatus 8 comprises a rope threading pulley 8-3, side plates 8-2 distributed on both sides of the rope threading pulley, and a bolt 8-1 connecting the rope threading pulley 8-3 and the side plates 8-2.

Figure 6:
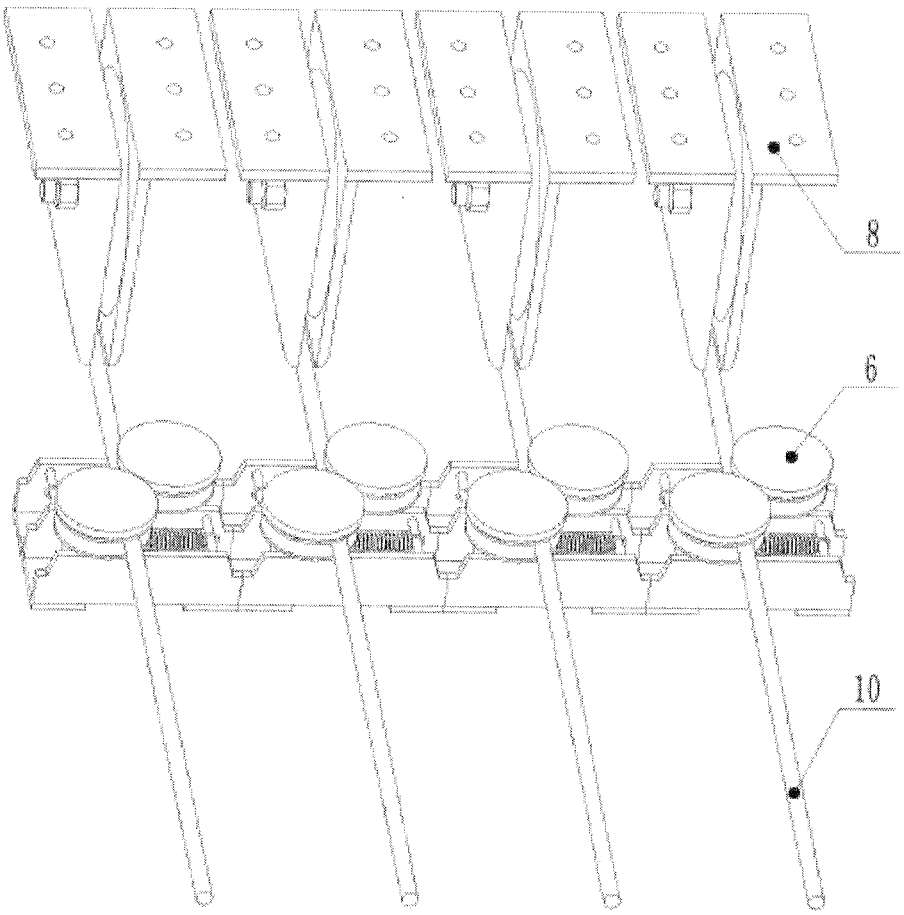
FIG. 6 is a schematic view of the relative position of the traction rope pulley apparatus passing through the traction rope pressing apparatus of the present invention.

Regarding the variable gradient inclined running container traction rope adjustment method of the present invention, when the inclined running container runs, the bearing member 5-1 of the traction rope lifting apparatus 5 will lift the traction rope 10 up, and the rotary wheel 6-2 of the traction rope pressing apparatus 6 will compress the traction rope 10, thereby achieving the forced guidance of the traction rope 10; and the traction rope pulley apparatus 8 is arranged at the bottom of the supporting seat 4 and the counterweight apparatus 7, and the number of the traction rope lifting apparatus 5, the traction rope pressing apparatus 6 and the traction rope pulley apparatus 8 is consistent with that of the traction ropes 10. When the car 1 or the counterweight apparatus 7 passes through the traction rope pressing apparatus 6, the upper wheels 6-1 will be pushed aside towards left and right sides via the side plates 8-2, so that the car 1 and the counterweight apparatus 7 can smoothly pass through the traction rope pressing apparatus 6; and after car 1 or the counterweight apparatus 7 passes through the traction rope pressing apparatus 6, the upper wheel 6-1 will return under the action of the spring 6-8, and the traction rope 10 will be pressed between the rotary wheels 6-2 again, as shown in FIG. 6.

The invention claimed is:

1. A variable gradient inclined running container traction rope adjustment apparatus, comprising upper and lower guide rails, a counterweight apparatus, a traction rope, a traction machine and a supporting seat supporting a car and riding on the upper guide rail, wherein the traction machine is arranged on the top of the variable slope;

one end of the traction rope winding around the traction machine is connected with the supporting seat running on the upper guide rail, and the other end is connected with the counterweight apparatus running on the lower guide rail;

the bottoms of the traction rope connecting car and the counterweight apparatus are respectively provided with a traction rope pulley apparatus;

a traction rope lifting apparatus is arranged on a support frame of the upper and lower guide rails, positioned at the lower section of the slope, and a traction rope pressing apparatus is arranged on the support frame positioned at the upper section of the slope;

a traction rope guide pulley is arranged below the traction machine; and, a movable connecting plate is arranged at the bottom of the car, one side of the front end of the upstream between the movable connecting plate and the supporting seat is hinged, and automatic leveling assembly is connected to one side of the rear end of the upstream.

2. The variable gradient inclined running container traction rope adjustment apparatus according to the claim 1, wherein the supporting seat comprises a lifting platform, a support frame arranged on the upper part of the lifting platform, and a car guide shoe arranged at the bottom of the lifting platform.

3. The variable gradient inclined running container traction rope adjustment apparatus according to the claim 1, wherein the traction rope lifting apparatus comprises a bearing member, angle cleats arranged at two ends of the bearing member, and a connecting shaft connecting the bearing member and the angle cleats.

4. The variable gradient inclined running container traction rope adjustment apparatus according to the claim 1, wherein the traction rope pressing apparatus comprises two connecting plates with the same structure, which are symmetrically fixed on the guide rail frame, three vertical plates with the same structure are arranged on the upper part of the connecting plate equidistantly in parallel;

a rotary wheel is arranged on the upper part of each vertical plate;

an upper wheel is arranged on the upper part of the rotary wheel;

rotary pins and positioning pins are respectively fixedly connected among the three vertical plates in parallel;

a rotary block rotating around the rotary pin is arranged on the rotary pin;

a connecting pin is arranged at the end of the rotary block;

a central shaft passing through the rotary wheel and connected with the upper wheel is welded on the upper part of the rotary block;

a bearing matched with the central shaft is arranged in the rotary wheel;

one end of the bearing is positioned via a shaft shoulder of the central shaft, and the other end is positioned via a shaft sleeve;

one end of the rotary wheel is limited via the bearing, and the other end is limited via a retainer ring;

a spring is arranged between the positioning pin and the connecting pin; and, one end of the spring is fixed to the positioning pin, and the other end of the spring is fixed to the connecting pin.

5. The variable gradient inclined running container traction rope adjustment apparatus according to the claim 1, wherein the counterweight apparatus comprises a front counterweight and a rear counterweight, the front and rear counterweights are hinged together, and counterweight guide shoes are arranged at the bottom of the front and rear counterweights symmetrically.

6. The variable gradient inclined running container traction rope adjustment apparatus according to the claim 1, wherein the traction rope pulley apparatus comprises a rope threading pulley, side plates distributed on both sides of the rope threading pulley, and a bolt connecting the rope threading pulley and the side plates.

7. A variable gradient inclined running container traction rope adjustment method using the apparatus in the claim 1, wherein when the inclined running container runs, a bearing member of the traction rope lifting apparatus will lift the traction rope up, and rotary wheels of the traction rope pressing apparatus will compress the traction rope, thereby achieving the forced guidance of the traction rope;

when the car or the counterweight apparatus passes through the traction rope pressing apparatus, side plates of the traction rope pulley apparatus arranged at the bottom of the supporting seat and the counterweight apparatus will push aside an upper wheel towards left and right sides, so that the car and the counterweight apparatus can smoothly pass through the traction rope pressing apparatus; and after the car or the counterweight apparatus passes through the traction rope pressing apparatus, the upper wheel will return under the action of a spring, and the traction rope will be pressed between the rotary wheels again.

* * * * *